US007605377B2

(12) United States Patent
Verbeck, IV et al.

(10) Patent No.: US 7,605,377 B2
(45) Date of Patent: Oct. 20, 2009

(54) ON-CHIP REFLECTRON AND ION OPTICS

(75) Inventors: Guido Fridolin Verbeck, IV, Plano, TX (US); Kenneth Tsui, Richardson, TX (US)

(73) Assignee: Zyvex Corporation, Richardson, TX (US)

( * ) Notice: Subject to any disclaimer, the term of this patent is extended or adjusted under 35 U.S.C. 154(b) by 420 days.

(21) Appl. No.: 11/550,241

(22) Filed: Oct. 17, 2006

(65) Prior Publication Data

US 2008/0087841 A1 Apr. 17, 2008

(51) Int. Cl.

| | |
|---|---|
| ***H01J 3/14*** | (2006.01) |
| ***H01J 23/04*** | (2006.01) |
| ***H01J 9/00*** | (2006.01) |
| ***G09G 1/04*** | (2006.01) |

(52) U.S. Cl. ..... 250/396 R; 250/281; 250/282; 250/287; 315/5.34; 315/5.37; 315/351; 257/249

(58) Field of Classification Search ..... 250/281, 250/282, 287, 396 R; 315/5.18, 5.19, 5.27, 315/5.28, 5.34, 5.37, 351; 257/249
See application file for complete search history.

(56) References Cited

U.S. PATENT DOCUMENTS

| | | | |
|---|---|---|---|
| 3,268,774 | A | 8/1966 | Ortner |
| 3,439,416 | A | 4/1969 | Yando |
| 3,467,942 | A | 9/1969 | Dell et al. |
| 3,588,618 | A | 6/1971 | Otte |
| 4,018,409 | A | 4/1977 | Burch et al. |
| 4,141,138 | A | 2/1979 | Quick |
| 4,383,195 | A | 5/1983 | Kolm et al. |
| 4,625,112 | A | 11/1986 | Yoshida |
| 4,740,410 | A | 4/1988 | Muller |
| 4,852,242 | A | 8/1989 | Tella et al. |
| 4,911,098 | A | 3/1990 | Tabata |
| 4,955,814 | A | 9/1990 | Christie et al. |
| 4,963,748 | A | 10/1990 | Szilagyi |
| 4,969,827 | A | 11/1990 | Hahs, Jr. |
| 5,025,346 | A | 6/1991 | Tang et al. |
| 5,072,288 | A | 12/1991 | MacDonald et al. |
| 5,092,781 | A | 3/1992 | Casciotti et al. |
| 5,113,117 | A | 5/1992 | Brooks et al. |

(Continued)

FOREIGN PATENT DOCUMENTS

| | | |
|---|---|---|
| DE | 19746585 | 4/1999 |

(Continued)

OTHER PUBLICATIONS

Arai et al., "A New Pick Up & Release Method By Micromanipulation," IEEE, Jan. 1997.

(Continued)

*Primary Examiner*—Bernard E Souw
(74) *Attorney, Agent, or Firm*—Haynes and Boone LLP

(57) ABSTRACT

A microelectronics apparatus comprising a substrate, a pair of grid electrodes coupled to the substrate on opposing sides of a central axis, wherein the grid electrodes are substantially parallel to each other and extend substantially perpendicular from the substrate, and a plurality of ion reflection lenses each coupled to the substrate, wherein each ion reflection lens: (1) is substantially perpendicular to each of the grid electrodes; (2) extends substantially perpendicular from the substrate; and (3) has an aperture aligned with the central axis.

18 Claims, 7 Drawing Sheets

U.S. PATENT DOCUMENTS 5,122,663 A 6/1992 Chang et al.
5,160,877 A 11/1992 Fujiwara et al.
5,215,923 A 6/1993 Kinoshita et al.
5,273,441 A 12/1993 Volz et al.
5,399,415 A 3/1995 Chen et al.
5,411,400 A 5/1995 Subrahmanyan et al.
5,464,985 A 11/1995 Cornish et al.
5,497,053 A * 3/1996 Tang et al. ..... 315/366
5,538,305 A 7/1996 Conway et al.
5,539,200 A 7/1996 Lebby et al.
5,610,335 A 3/1997 Shaw et al.
5,645,684 A 7/1997 Keller
5,657,516 A 8/1997 Berg et al.
5,660,680 A 8/1997 Keller
5,724,728 A 3/1998 Bond et al.
5,746,621 A 5/1998 Cronin
5,774,956 A 7/1998 French et al.
5,806,152 A 9/1998 Saitou
5,818,748 A 10/1998 Bertin
5,848,456 A 12/1998 Sjoqvist
5,867,302 A 2/1999 Flemming
5,895,084 A 4/1999 Mauro
5,963,788 A 10/1999 Barron et al.
6,013,913 A 1/2000 Hanson
6,103,399 A 8/2000 Smela et al.
6,131,277 A 10/2000 Cadenhead et al.
6,154,936 A 12/2000 Howell et al.
6,193,139 B1 2/2001 Kivilahti
6,193,541 B1 2/2001 Lee
6,215,081 B1 4/2001 Jensen et al.
6,218,664 B1 4/2001 Krans et al.
6,219,254 B1 4/2001 Ackerling et al.
6,239,685 B1 5/2001 Albrecht et al.
6,257,925 B1 7/2001 Jones
6,263,549 B1 7/2001 Uehara
6,300,156 B1 10/2001 Decker et al.
6,303,885 B1 10/2001 Hichwa et al.
6,321,654 B1 11/2001 Robinson
6,365,892 B1 4/2002 Cotter et al.
6,396,711 B1 5/2002 Degani et al.
6,398,280 B1 6/2002 Parker et al.
6,429,113 B1 8/2002 Lewis et al.
6,483,419 B1 11/2002 Weaver et al.
6,488,315 B1 12/2002 Brenner et al.
6,531,947 B1 3/2003 Weaver et al.
6,561,725 B1 5/2003 Ellis et al.
6,607,414 B2 8/2003 Cornish et al.
6,617,522 B2 9/2003 Tabacutu
6,672,795 B1 1/2004 Ellis et al.
6,676,416 B1 1/2004 Ellis et al.
6,678,458 B2 1/2004 Ellis
6,679,055 B1 1/2004 Ellis
6,691,513 B1 2/2004 Kolesar
6,745,567 B1 6/2004 Mercanzini
6,762,116 B1 7/2004 Skidmore
6,764,325 B2 7/2004 Arrigotti et al.
6,803,725 B2 * 10/2004 Jin ..... 315/3.5
6,818,889 B1 * 11/2004 Sheehan et al. ..... 250/288
6,837,723 B1 1/2005 Randall et al.
6,862,921 B2 3/2005 Chand et al.
6,878,930 B1 * 4/2005 Willoughby et al. ..... 250/281
6,881,074 B1 4/2005 McLenaghan
6,923,669 B1 8/2005 Tsui et al.
6,949,740 B1 * 9/2005 Sheehan et al. ..... 250/288
6,956,219 B2 10/2005 Saini et al.
6,982,515 B2 1/2006 Howell et al.
7,012,491 B1 3/2006 Geisberger et al.
7,025,619 B2 4/2006 Tsui et al.
7,075,209 B2 7/2006 Howell et al.
7,081,630 B2 7/2006 Saini et al.
7,259,510 B1 * 8/2007 Gammel et al. ..... 313/497
7,306,338 B2 * 12/2007 Hansen et al. ..... 353/20
2001/0010348 A1 8/2001 Bilanin et al.
2002/0125208 A1 9/2002 Christenson et al.
2003/0201654 A1 10/2003 Ellis
2003/0210115 A1 11/2003 Kubby et al.
2004/0108550 A1 * 6/2004 Jin ..... 257/342
2004/0135526 A1 7/2004 Winkler et al.
2007/0138888 A1 6/2007 Pinkerton et al.
2007/0293115 A1 * 12/2007 Gammel et al. ..... 445/29
2008/0017794 A1 * 1/2008 Verbeck ..... 250/292
2008/0078506 A1 * 4/2008 Verbeck et al. ..... 156/345.48
2008/0078745 A1 * 4/2008 Cordell et al. ..... 216/67
2008/0087841 A1 * 4/2008 Verbeck et al. ..... 250/396 R

FOREIGN PATENT DOCUMENTS

EP 0490530 6/1992
EP 0497620 8/1992
JP 57161819 10/1982
JP 05166973 7/1993
JP 06061691 3/1994
WO WO 9713981 4/1997

OTHER PUBLICATIONS

Capanu et al., "Design, Fabrication, and Testing of a Bistable Electromagnetically Actuated Microvalve", Journal of Microelectromechanical Systems, vol. 9, No. 2, Jun. 2000, pp. 181-188.
Cohn et al., "Microassembly Technologies for MEMS", University of California at Berkley and University of Washington.
Cohn et al., "Self-Assembling Electrical Networks: An Application of Micromachining Technology", May 1991.
Comtois et al. "Applications for surface-micromachined polysilicon thermal actuators and arrays," Sensors and Actuators A58, 1997, pp. 19-25.
Comtois et al. "Electrothermal actuators fabricated in four-level planarized surface micromachined polycrystalline silicon," Sensors and Actuators A70, 1998, pp. 23-31.
Comtois et al., "Thermal Microactuators for surface-micromachining processes," SPIE vol. 2642, 1995, pp. 10-21.
Dechev et al., "Microassembly of 3-D Microstructure Using a Compliant, Passive Microgripper", Journal of Microelectromechanical Systems, vol. 13, No. 2, Apr. 2004, pp. 176-189.
Ellis et al., "High Aspect Ratio Silicon Micromechanical Connectors", High Aspect Ratio Micro-Structure Technology Workshop, Jun. 15-17, 2003, Monterey, California USA.
Ezekiel et al., "Surface-Micromachined Components for Articulated Microbots", Journal of Microelectromechanical Systems, vol. 5, No. 1, (Mar. 1996).
Fearing, "Survey of Sticking Effects for Micro Parts Handling", IEEE, Apr. 1995.
Gomm et al., "In-Plane Linear Displacement Bistable Microrelay", 2002 IOP Publishing Ltd., UK, pp. 257-264.
Gracias et al., "Forming Electrical Networks in Three Dimensions by Self-Assembly", Science, vol. 289, Aug. 18, 2000, pp. 1170-1172.
Handbook of Industrial Robotics, Shimon Y. Nof, Editor, Chapter 26 and Section 4.1.4., pp. 478-479.
Handbook of Industrial Robotics, Shimon Y. Nof, Editor, Second Edition, 1999, Chapter 5, pp. 43-78.
Harsh et al., "Flip-Chip Assembly for Si-Based RF MEMS", NSF Center for Advanced Manufacturing and Packaging of Microwave, Optical and Digital Electronics, Department of Mechanical Engineering, University of Colorado.
Harsh et al., "Solder Self-Assembly for MEMS", NSF Center for Advanced Manufacturing and Packaging of Microwave, Optical and Digital Electronics, Department of Mechanical Engineering, University of Colorado.
Hitakawa, "Advanced Parts Orientation System Has Wide Application", Aug. 1988.
IBM Technical Disclosure Bulletin, "Chip-to-Chip Cable Connection," IBM Corp., vol. 27, No. 11, Apr. 1985, pp. 6761-6763.
International Preliminary Examination Report in PCT/US01/015011 dated Sep. 13, 2002.

International Preliminary Examination Report in PCT/US01/15059 dated Aug. 2, 2002.
International Preliminary Examination Report in PCT/US01/24173 dated Jan. 17, 2003.
International Search Report in PCT/US01/015011 dated Dec. 3, 2001.
International Search Report in PCT/US01/15059 dated Dec. 12, 2001.
International Search Report in PCT/US01/24173 dated May 17, 2002.
Jensen et al., "Design Optimization of a Fully-Compliant Bistable Micro-Mechanism", Proceedings of 2001 ASME International Mech. Eng. Congress and Expo., New York, Nov. 2001, pp. 1-7.
Keller et al., "Hexsil Tweezers for Teleoperated Microassembly", IEEE Micro Electro Mechanical Systems Workshop, 1997, pp. 72-77.
Keller, Microfabricated High Aspect Ratio Silicon Flexures, 1998.
Kruglick et al., "Bistable MEMS Relays and Contact Characterization", University of California Berkeley Sensors and Actuators Center, pp. 1-5.
Maekoba et al., "Self-Aligned Vertical Mirror and V-Grooves Applied to an Optical-Switch: Modeling and Optimization of Bistable Operation by Electromagnetic Actuation", Sensors and Actuators A 87, 2001, pp. 172.178.
Mohr, "LIGA-A Technology for Fabricating Microstructures and Microsystems," Sensors and Materials, vol. 10, No. 6, 1998, pp. 363-373.
Muray et al., "Advances in Arrayed Microcolumn Lithography", Journal of Vacuum Science and Technology. B, Microelectronics and Nanometer Structures Processing, Measurement and Phenomena: An Official Publication of the American Vacuum Society, vol. 18 (6), Nov./Dec. 2000, pp. 3099-3104. (IRN10495228).
Prasad et al., "Design, Fabrication, and Characterization of Single Crystal Silicon Latching Snap Fasteners for Micro Assembly", Proc. ASME Int.Mech.Eng. Congress and Expo. (IMECE'95), San Francisco, CA, Nov. 1995.
Qiu et al., "A Centrally-Clamped Parallel-Beam Bistable MEMS Mechanism", IEEE 2001, pp. 353-356.
Schreiber et al., "Surface Micromachined Electrothermal V-Beam Micromotors", Proc of 2001 ASME International Mechanical Engineering Congress and Exp., Nov. 11, 2001.
Szilagyi et al., "Synthesis of Electrostatic Focusing and Deflection Systems", JVST B, 15(6), Nov./Dec. 1997, p. 1971.
Taher et al., "On a Tunable Bistable MEMS- Theory and Experiment", Journal of Microelectromechanical Systems, vol. 9, No. 2, Jun. 2000, pp. 157-170.
Tsui et al., Micromachined End-Effector and Techniques for Directed MEMS Assembly, Journal of Micromechanics and Microengineering, Institute of Physics Publishing, United Kingdom 2004, pp. 1-8.
United States Patent Final Office Action from U.S. Appl. No. 10/238,319, dated May 17, 2005.
United States Patent Office Action from U.S. Appl. No. 11/074,448, dated Aug. 16, 2005.
United States Patent Office Action from U.S. Appl. No. 11/131,760, dated Jul. 13, 2007.
United States Patent Office Action from U.S. Appl. No. 10/133,936 dated Mar. 26, 2004.
United States Patent Office Action from U.S. Appl. No. 10/133,936 dated May 31, 2005.
United States Patent Office Action from U.S. Appl. No. 10/238,319, dated Nov. 17, 2004.
United States Patent Office Action from U.S. Appl. No. 10/238,319, dated Jun. 16, 2004.
United States Patent Office Action from U.S. Appl. No. 09/643,011, dated Aug. 27. 2002.
United States Patent Office Action from U.S. Appl. No. 09/569,329, dated Sep. 13, 2001.
United States Patent Office Action from U.S. Appl. No. 09/570,170, dated Jul. 22, 2002.
United States Patent Office Action from U.S. Appl. No. 09/570,170, dated Sep. 7, 2001.
United States Patent Office Action from U.S. Appl. No. 10/154,685, dated Oct. 3, 2003.
United States Patent Office Final Office Action from U.S. Appl. No. 10/154,685, dated Apr. 6, 2004.
United States Patent Office Notice of Allowance from U.S. Appl. No. 10/799,836, dated May 18, 2005.
United States Patent Office Notice of Allowance from U.S. Appl. No. 10/987,871, dated Jun. 6, 2005.
United States Patent Office Notice of Allowance from U.S. Appl. No. 10/154,685, dated Aug. 20, 2004.
United States Patent Office Notice of Allowance from U.S. Appl. No. 10/616,735 dated Apr. 17, 2006.
United States Patent Office Notice of Allowance from U.S. Appl. No. 09/570,170, dated Jan. 3, 2002.
Yeh et al., "Fluidic Self-Assembly of Microstructures and its Application to the Integration of GaAs on Si", IEEE, Jan. 1994, pp. 279-284.
Yeh et al., "Single Mark , Large Force, and Large Displacement Electrostatic Linear Inchwork Motors," Berkley Sensor and Actuator Center, Department of Electrical Engineering and Computer Science, University of California, Berkley.
Yeh et al., "Surface-Micromachined Components for Articulated Microrobots" Journal of Microelectromechanical Systems, vol. 5, No. 1, Mar. 1996.

* cited by examiner

ON-CHIP REFLECTRON AND ION OPTICS

CROSS-REFERENCE TO RELATED APPLICATIONS

This disclosure is related to the following commonly-assigned U.S. Patent Applications, each of which is hereby incorporated herein by reference:

- U.S. patent application Ser. No. 10/778,460, entitled "MEMS MICROCONNECTORS AND NON-POWERED MICROASSEMBLY THEREWITH," filed Feb. 13, 2004;
- U.S. patent application Ser. No. 10/799,836, entitled "COMPACT MICROCOLUMN FOR AUTOMATED ASSEMBLY," filed Mar. 12, 2004; and
- U.S. patent application Ser. No. 11/074,448, entitled "SOCKETS FOR MICROASSEMBLY," filed Mar. 8, 2005.

BACKGROUND

A spectrometer is an analytical instrument in which an emission (e.g., particles or radiation) is dispersed according to some property of the emission (e.g., mass or energy), and the amount of dispersion is then measured. Analysis of the dispersion measurement can reveal information regarding the emission, such as the identity of the individual particles of the emission.

One type of spectrometer is a mass spectrometer, which can be used to determine the chemical composition of substances and the structures of molecules. One type of mass spectrometer is a time-of-flight (TOF) mass spectrometer, which records the mass spectra of compounds or mixtures of compounds by measuring the time (e.g., in tens to hundreds of microseconds) for molecular and/or fragment ions of those compounds to traverse a drift region within a high vacuum environment. TOF mass spectrometers operate based on the principle that, when ions are accelerated with a fixed energy, the velocity of the ions depend exclusively on mass and charge. Thus, the time-of-flight of an ion drifting from point A to point B will differ depending on the mass of the ion. Using a TOF mass spectrometer, the mass of an ion can be calculated based upon its time of flight. This allows the molecule to be identified with precision.

TOF mass spectrometers are comprised of a source region, where neutral molecules are ionized, a drift region, followed by an ion reflector (also known as a reflectron) and a detector. The ion source provides a high vacuum environment in which ions are formed, and the ions are subsequently accelerated into a drift region (which may be field-free). The ions separate in time, depending only on their mass/charge ratio (the ion charge is often +1). Upon entering the opposing field created by the reflectron, the ions gradually slow down until they ultimately stop and reverse direction. Ion detection occurs after the ions are re-accelerated back out of the reflectron. In addition to enabling the calculation of the mass of the ions, ion packet peak widths are sharpened by their passage through the reflectron, resulting in an enhancement of the instrument's resolving power.

Reflectrons have been in use since the late 1960's and are typically constructed by configuring a series of individually manufactured metallic rings along ceramic rods using insulating spacers to separate each ring from the next. This technique is labor intensive, costly, and limits the flexibility of design due to the manufacture and handling of extremely thin rings (e.g., a few mils in thickness) of relatively large diameter (often 1" or greater). An example of such a configuration is shown in U.S. Pat. No. 4,625,112 to Yoshida, which is hereby incorporated herein by reference.

The rings are often placed at potentials that develop uniform electric fields along the axis of the cylinder. However, to improve performance in a TOF mass spectrometer, reflectrons have also been constructed which develop non-uniform fields along the reflectron tube. The non-uniform fields are generated by utilizing a voltage divider network which varies the potential applied to each of the evenly-spaced rings. A detailed explanation of non-linear reflectron theory can be found in U.S. Pat. No. 5,464,985 to Cornish, et al., which is hereby incorporated in its entirety herein by reference.

Additional examples of reflectrons and TOF mass spectrometry theory can also be found in U.S. Pat. No. 6,013,913 to Hanson, U.S. Pat. No. 6,365,892 to Cotter, et al., and U.S. Pat. No. 6,607,414 to Cornish, et al., each of which is hereby incorporated herein by reference.

While the above-described TOF mass spectrometer design has proved quite satisfactory for large reflectors in which the rings are relatively large in diameter and equally spaced, new applications utilizing remote and/or mobile TOF mass spectrometers may require miniaturized components, rugged construction, and/or lightweight materials.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
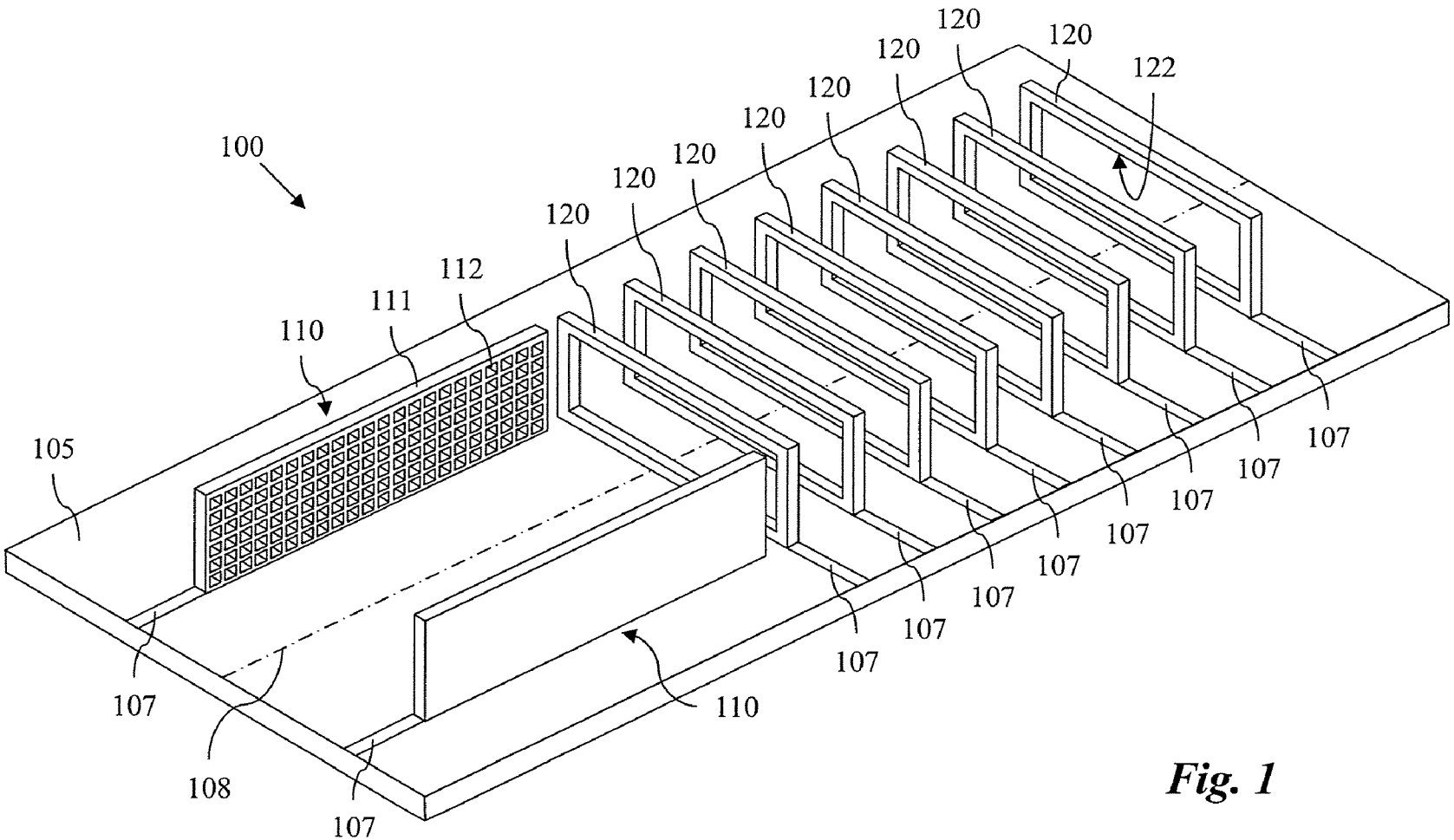
FIG. 1 is a perspective view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a perspective view of at least a portion of an apparatus 100 according to one or more aspects of the present disclosure. The apparatus 100 may be, or may be a portion of, a reflectron, mass spectrometer, and/or other ion optics device.

The apparatus 100 includes a substrate 105, a pair of grid electrodes 110, and a plurality of ion reflection lenses 120. The ion reflection lenses 120 may be coupled to the substrate 105 by adhesive, bonding, soldering, brazing, mechanical clips and other fasteners, combinations thereof, and/or other means.

In an exemplary embodiment, the grid electrodes 110 and/or the ion reflection lenses 120 may be coupled to the substrate 105 by connector/socket pairs, such as those shown in U.S. patent application Ser. No. 10/778,460, entitled "MEMS MICROCONNECTORS AND NON-POWERED MICROASSEMBLY THEREWITH," filed Feb. 13, 2004, . For example, each of the grid electrodes 110 and/or the ion reflection lenses 120 may include an integral connector (also referred to herein as a microconnector or microconnector portion) for engaging a corresponding socket on the substrate 105. The connectors may also be separate components bonded or otherwise coupled to the grid electrodes 110 and/or the ion reflection lenses 120. The substrate 105 may also include traces or other conductive members 107 electrically connected to corresponding sockets for providing current and/or biasing signals to the ones of the grid electrodes and/or the ion reflection lenses 120.

The grid electrodes 110 may comprise a body portion 111 and a plurality of conductive grid portions 112. For example, the body portion 111 may comprise silicon or other dielectric or semiconductive material, and the conductive grid portions 112 may comprise gold or other conductive materials deposited on the body portion 111 and/or within a plurality of recesses formed within the body portion 111. In an exemplary embodiment, the grid electrodes 110 may be formed from the same substrate as the substrate 105, then separated from the substrate 105, and subsequently positioned and coupled into the position shown in FIG. 1. However, other materials and/or manufacturing methods are also within the scope of the present disclosure.

The grid electrodes 110 may be oriented substantially parallel to one another on opposing sides of a central axis 108, such that conductive grid portions 112 of the grid electrodes 110 each face the central axis 108. The grid electrodes 110 may be substantially equidistant from the central axis 108.

Each lens 120 may be spaced in series in alignment with the central axis 108. For example, each lens 120 may comprise a central aperture 122 which may be bisected by a plane extending perpendicular from the substrate 105 through the central axis 108.

Figure 2:
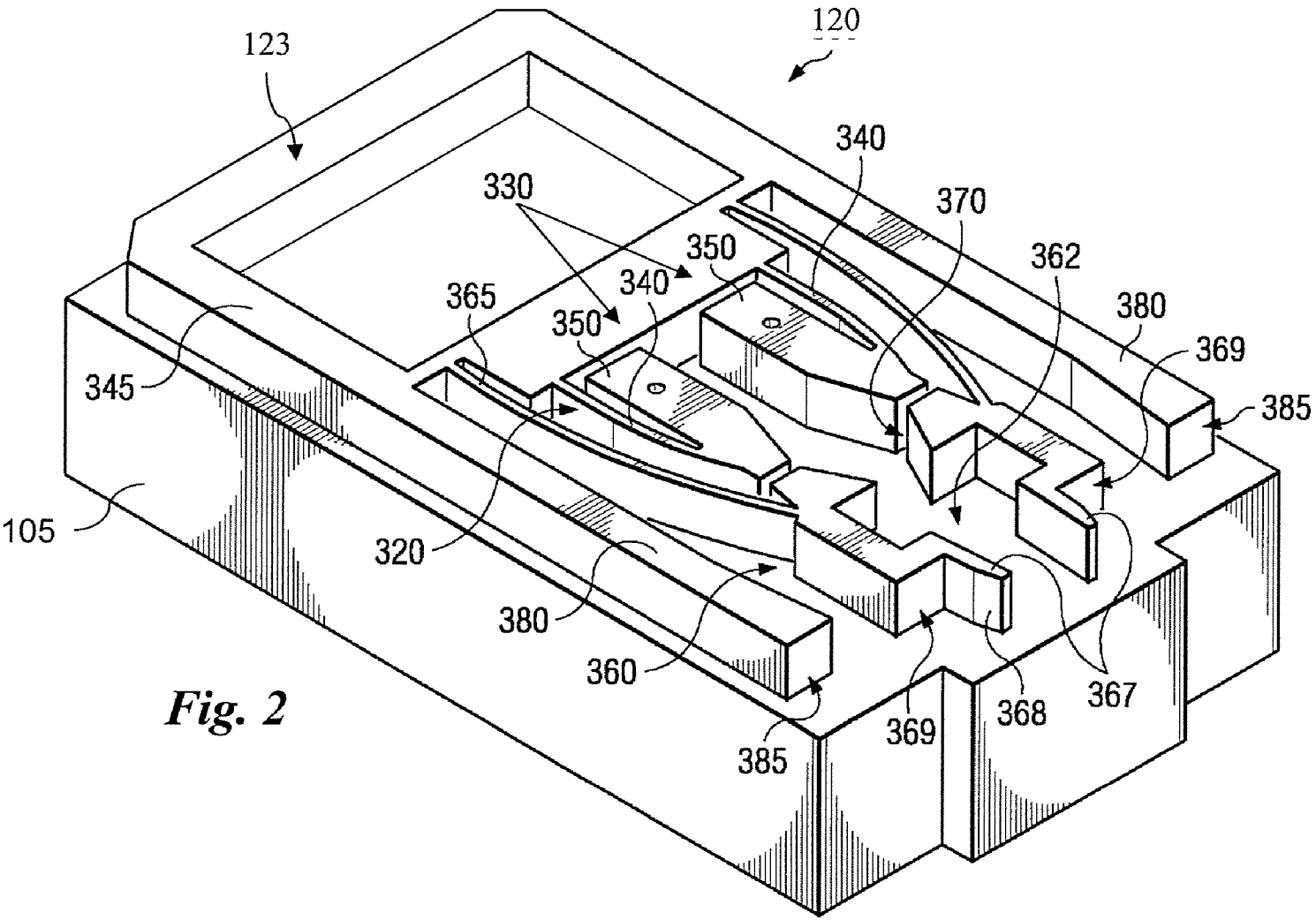
FIG. 2 is a perspective view of apparatus according to one or more aspects of the present disclosure.

Referring to FIG. 2, illustrated is a perspective view of at least a portion of an exemplary embodiment of one of the ion reflection lenses 120 shown in FIG. 1. The lens 120 may be defined in a single-crystalline silicon (SCS) layer, possibly having a thickness ranging between about 25 μm and about 200 μm. The SCS layer may be located over a sacrificial layer formed over a substrate 105, wherein the sacrificial layer may comprise oxide and/or other materials and may have a thickness ranging between about 1 μm and about 30 μm. One or more deep reactive ion etching (DRIE) processes and/or other processes may be employed to define the lens 120 from the SCS layer. Such a manufacturing process flow may include a backside DRIE through the substrate 105 or a handle portion thereof. In-plane electrical isolation may be achieved by trenches formed in the SCS layer and filled with nitride and/or another electrically insulating material. The lens 120 is released from the substrate 105 after fabrication and prior to assembly. Such a release process may employ a wet-etch of the sacrificial layer, possibly employing a 49% HF solution or other etchant chemistry.

The lens 120 may include a handle 320 configured to frictionally engage a manipulation probe, such as the probe shown in U.S. patent application Ser. No. 10/778,460, entitled "MEMS MICROCONNECTORS AND NON-POWERED MICROASSEMBLY THEREWITH," filed Feb. 13, 2004. In an exemplary embodiment, the handle 320 is defined in the SCS layer as having two or more compliant legs 330 configured to deflect away from each other in response to insertion of the manipulation probe. Thus, the handle 320 may be a compliant handle. The legs 330 may be formed separated from each other by a distance about equal to or at least slightly less than the width of the manipulation probe tip or other portion configured to be grasped by the legs 330. In one embodiment, such separation between the legs 330 may range between about 25 μm and about 300 μm. Although not limited by the scope of the present disclosure, the legs 330 may have a length ranging between about 50 μm and about 500 μm.

As in the illustrated embodiment, the legs 330 (or perhaps one or more other portions of the handle 320) may each include narrower members 340 connected at one end to a body 345 of the lens element 120, and connected at a second end to wider members 350 configured to grasp the manipulation probe. The narrower members 340 may each have a width ranging between about 5 μm and about 30 μm, and the wider members 350 may each have a width ranging between about 10 μm and about 100 μm.

The lens 120 also includes a deflectable connection member 360 having at least one first end 365 coupled to the handle, possibly via the body 345, as in the illustrated embodiment. The connection member 360 also includes at least one second end 367 configured to deflect and thereby engage a receptacle in response to disengagement of a manipulation probe from the handle 320. The one or more second ends 367 may include a barb, hook, lip, extension, tab, and/or other means 368 (hereafter collectively referred to as a barb) for engaging, mating or otherwise interfacing with an edge, surface or barb of the receptacle. The one or more second ends 367 may also include a shoulder or other interface means 369 (hereafter collectively referred to as a shoulder) for engaging, mating or otherwise interfacing with an edge, surface or barb of the receptacle, in addition to or as an alternative to the barb 368.

The connection member 360 may include tapered surfaces 370 or other means for deflecting outward in response to translation of the manipulation probe away from a retained position within the handle 320. The connection member 360 may also include an aperture 362 permitting removal of the manipulation probe after the lens 120 is secured to the receptacle. The width of the aperture 362 may be about equal to or at least slightly greater than a manipulation probe or tip thereof. The lens 120 may also include one or more anchor arms 380 coupled or integral to the body 345 and extending to a bearing plane, shoulder or other type of interface 385 configured to rest against a receptacle as a manipulation probe is translated from the handle 320 towards the aperture 362.

Although not shown in the illustrated embodiment, the lens 120 may also include means for detecting when the lens 120 is fully engaged with a receptacle. For example, the interface means 369 may include conductive contacts and/or other means which may close a circuit across anchor pads of the receptacle. In one embodiment, the connection member 360 may be similarly or alternatively configured to close a circuit across the receptacle, thereby indicating engagement of the lens 120 and the receptacle.

As also described above, the lens element 120 includes a central aperture 122 configured to influence the path of an ion passing therethrough. In an exemplary embodiment, at least a portion of the central aperture 122 may be metallized. For example, in the illustrated example, a layer of gold or other conductive metal may surround the central aperture 122 and extend along the arms 380 for contacting conductive anchor pads of the substrate 105 or receptacles formed therein. Alternatively, the entire surface 123 of the lens 120, or a substantial portion thereof, may include a layer of conductive material. The metallized central aperture is configured to create an electronic field configured to modify direction of ion flight therethrough.

Figure 3:
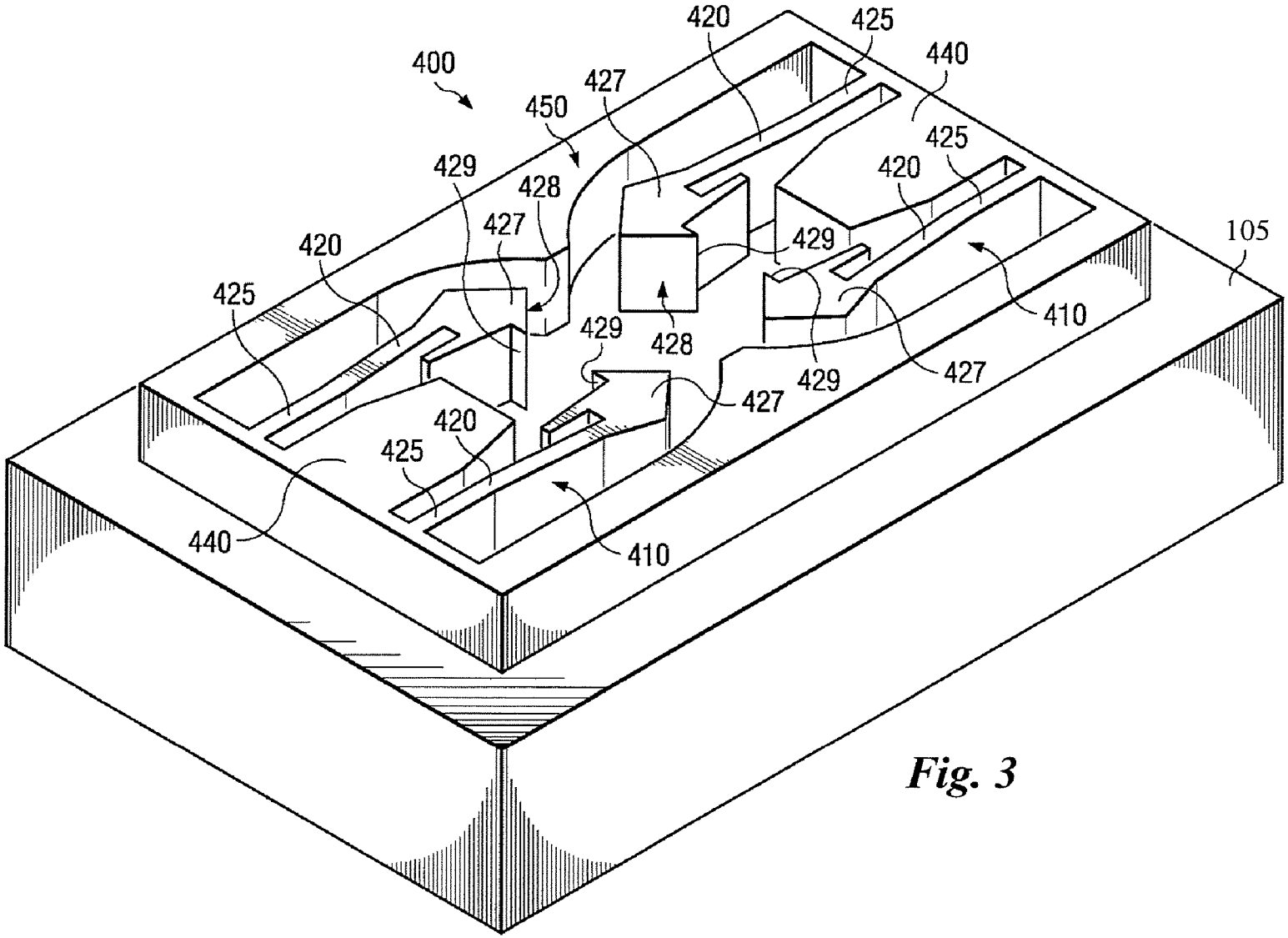
FIG. 3 is a perspective view of apparatus according to one or more aspects of the present disclosure.

Referring to FIG. 3, illustrated is a perspective view of at least a portion of an exemplary embodiment of a receptacle 400 constructed according to aspects of the present disclosure. A plurality of the receptacles 400 may be formed in or coupled to the substrate 105 shown in FIG. 1, such that each of the lens elements 120 shown in FIG. 1 is secured to the substrate 105 via a corresponding one of the receptacles 400. The receptacle 400 may be substantially similar in composition and manufacture to the lens 120 shown in FIG. 2. In one embodiment, a plurality of receptacles 400 and lens elements 120 are defined in a common SCS layer over a common substrate 105, possibly simultaneously.

The receptacle 400 includes one, two or more deflectable retainers 410. The retainers 410 each include one, two, or more legs 420. The legs 420 each include a first end 425 coupled to the substrate 105 and a second end 427 configured to translate across the substrate 105. The translation of the second ends 427 of the legs 420 across the substrate 105 may be in response to the travel of a portion of a microconnector portion of a lens element 120 (such as the second ends 367 of the lens 120 shown in FIG. 2) against tapered surfaces 428 of the second ends 427. Each of the second ends 427 may also include a barb, hook, lip, extension, tab, and/or other means 429 (hereafter collectively referred to as a barb) for engaging, mating or otherwise interfacing with an edge, surface or barb of a microconnector portion of a lens 120.

The receptacle 400 may also include one or more anchor pads 440 coupled or integral thereto. The anchor pads 440 may be configured to resist translation (e.g., provide a travel "stop") of a microconnector portion of a lens 120 as a manipulation probe is translated therein towards the receptacle 400. For example, the anchor pads 440 may be configured to interface with the anchor arm interfaces 385 shown in FIG. 2.

The receptacle 400 may also include an aperture 450 configured to receive a microconnector portion of a lens 120 during microassembly. For example, the aperture 450 may be sized to receive the ends 367 of the microconnector 300 shown in FIG. 2. Thus, a microconnector portion of a lens 120 may be inserted into the aperture 450 of the receptacle 400 until the anchor pads 440 stop translation of the microconnector portion of lens 120 into the receptacle 400, such that further translation of a manipulation probe therein towards the receptacle 400 causes the retainers 410 to deflect and subsequently engage with the microconnector portion of the lens 120.

Figure 4:
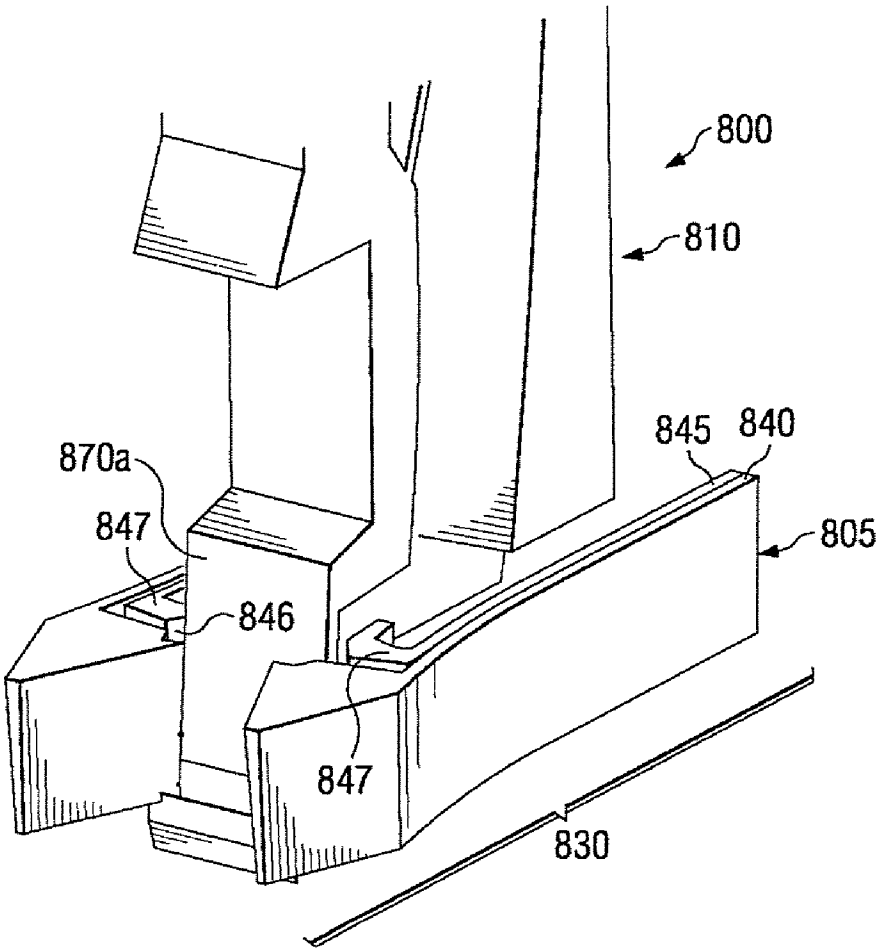
FIG. 4 is a perspective view of apparatus according to one or more aspects of the present disclosure.

Referring to FIG. 4, illustrated is a perspective view of at least a portion of an exemplary embodiment of a microassembly 800 according to aspects of the present disclosure. The microassembly 800, or at least the illustrated portion thereof, includes a receptacle 805 and a microconnector 810. The microconnector 810 may be substantially similar in construction, materials, geometry and/or operation relative to the above-described microconnector portion of the lens 120 shown in FIGS. 1 and 2. For example, among other similar characteristics between the microconnector 810 and the lens 120, the microconnector 810 may have a thickness that is no greater than about 1000 microns. In one embodiment, the microconnector 810 has a thickness of about 1000 microns.

The receptacle 805 may also be substantially similar in construction, materials, geometry and/or operation relative to the receptacle 400 shown in FIG. 3, and may be formed in or coupled to the substrate 105 shown in FIG. 1 for receiving a corresponding one of the lenses 120 shown therein. For example, in the exemplary embodiment shown in FIG. 4, the receptacle 805 includes a retainer 830 having two legs 840, where the retainer 830 and the legs 840 are substantially similar to the retainer 410 and the legs 420 shown in FIG. 3. Additionally, as with the previously described receptacles, the receptacle 805 (or portions thereof) may have a thickness that is no greater than about 1000 microns, such as an exemplary embodiment in which the thickness is about 1000 microns.

The retainer 830 (and/or another portion of the receptacle 805) also includes two fingers 845. Like the legs 840, the fingers 845 may be or include substantially elongated members, possibly being substantially greater in thickness than in width and possibly greater in length that in width or thickness, such that the fingers 845 have sufficient flexibility to permit deflection when contacted with a portion of the microconnector 810. As shown in FIG. 4, the fingers 845 may collectively interpose the legs 840. Moreover, the fingers 845 may each have an outer profile (or footprint relative to an underlying substrate) that substantially conforms or corresponds to, or is otherwise substantially similar to, an inner profile of a proximate one of the legs 840. For example, the outer profile of one or more of the fingers 845 may be offset radially inward by a substantially constant distance from the inner profile of a proximate one of the legs 840. Moreover, as with the legs 840, the fingers 845 may be mirror-images of one another.

The fingers 845 are coupled to or otherwise affixed to a substrate at ends proximate the location where the legs 840 are coupled to the substrate, such that, like the legs 840, other ends 847 of the fingers 845 are free to translate across the substrate. The ends 847 may have tapered surfaces 846, such that insertion of a portion of the microconnector 810 therebetween causes the fingers 845 to deflect away from each other yet remain in contact with the inserted portion of the microconnector 810.

In other embodiments similar to the exemplary embodiment shown in FIG. 4, a different number of legs 840 and/or fingers 845 may be employed. For example, in an exemplary embodiment, only one finger 845 may be employed in addition to the two legs 840, while another embodiment may employ three or more fingers 845. In any case, the fingers 845 may be formed integral to the receptacle 805, such as by processes described above, possibly simultaneously with the formation of the legs 840. In other embodiments, the fingers 845 may be discrete components adhered or otherwise coupled to the receptacle 805.

The fingers 845 may, in some embodiments, improve the robustness and/or alignment of the microassembly 800. For example, in embodiments in which the fingers 845 are not employed, the contact between the microconnector 810 and the receptacle 805 may be limited to point and/or line contact at only two locations. However, in some embodiments employing one or more of the fingers 845, the contact between the microconnector 810 and the receptacle 805 may include point and/or line contact at three or more locations, which may improve the robustness and/or alignment of the coupling between the microconnector 810 and the receptacle 805.

As described above, assembling the microconnector 810 to the receptacle 805 can include the deflection of ends of the microconnector 810 (or ends of legs or leg portions of the microconnector 810). Such deflection may be in and/or establish a first plane of motion, which may be substantially perpendicular to a second plane in which the legs 840 and/or the fingers 845 deflect. For example, if the receptacle 805 is formed on or from a substrate, the legs of the microconnector 810 may deflect in a first plane that is substantially perpendicular to the substrate, whereas the legs 840 and/or the fingers 845 of the receptacle 805 may deflect in a second plane that is substantially parallel to the substrate. After assembly, the legs 840 and/or the fingers 845 may contact at least three locations on the microconnector 810, and the fingers 845 may be configured such that one of these three or more contact locations is offset from the other contact locations relative to the first plane, the second plane, or both the first and second planes.

Figure 5A:
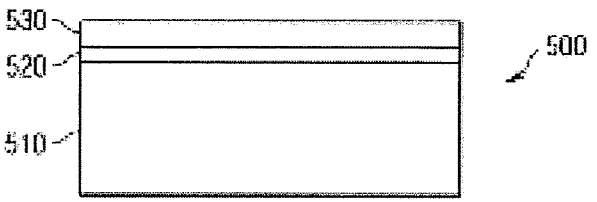
FIGS. 5A-5D are schematic sectional side views of apparatus in various stages of manufacture according to one or more aspects of the present disclosure.

Referring to FIG. 5A, illustrated is a sectional view of at least a portion of an exemplary embodiment of a component or substrate in the apparatus shown in FIGS. 1-4, herein designated by the reference numeral 500, in an intermediate stage of manufacture according to aspects of the present disclosure. The manufacturing stage depicted in FIG. 5A may be an initial stage of manufacture. The manufacturing method contemplated by FIG. 5A and subsequent figures may be employed during the manufacture of the substrate 105, the lenses 120, and receptacles receiving the lenses 120, as shown in FIG. 1, the lens 120 shown in FIG. 2, the receptacle 400 shown in FIG. 3, the components shown in FIG. 4, and/or other components within the scope of the present disclosure.

As shown in FIG. 5A, the component 500 includes a substrate 510 which, at least in one embodiment, may be a silicon-on-insulator (SOI) substrate. An insulating layer 520 may be included in the substrate 510 or may be formed on or over the substrate 510. The insulating layer 520 may comprise silicon dioxide and/or other insulating materials, and may comprise more than one layer. The insulating layer 520 may also be or include a buried oxide layer, such as that formed by implanting oxide ions into the substrate 510. A device layer 530 may also be included in the substrate 510 or may be formed on or over the insulating layer 520. The device layer 530 may comprise silicon, doped polysilicon, and/or other conductive or semiconductive materials, and may comprise more than one layer. The device layer 530 may also comprise an insulator coated with a conductive material. In one embodiment, the device layer 530 may have a thickness of about 50 μm.

Figure 5B:
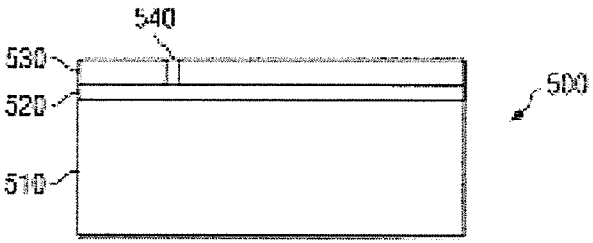

Referring to FIG. 5B, illustrated is a sectional view of the component 500 shown in FIG. 5A in a subsequent stage of manufacture according to aspects of the present disclosure. One or more isolation structures 540 may be formed extending through the device layer 530 to the insulating layer 520 and/or the substrate 510. The isolation structures 540 may be or include shallow trench isolation structures or other features possibly formed by etching recesses or other openings in the device layer 530 and subsequently filling the openings with one or more insulating materials. The isolation structures 540 may comprise nitride, silicon nitride, silicon dioxide, and/or other materials. The isolation structures 540 may be employed to define electrodes on the component 500. The isolation structures 540 may also be employed to electrically isolate features formed on the component 500. In one embodiment, multiple instances of the component 500 may be formed on a single substrate, wafer, chip or die area. For example, the lens components 120 and each of the receptacles receiving the lens components 120 shown in FIG. 1 may be formed from or on a common substrate. In such an embodiment, the isolation structures 540 may be employed to electrically isolate each of these components.

Figure 5C:
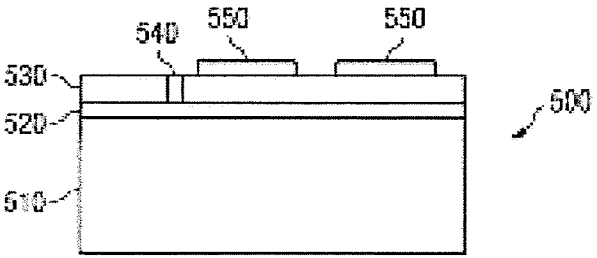

Referring to FIG. 5C, illustrated is a sectional view of the component 500 shown in FIG. 5B in a subsequent stage of manufacture according to aspects of the present disclosure. A conductive layer 550 is formed over the device layer 530, such as by selective deposition or by blanket deposition followed by a patterning process. The conductive layer 550 may comprise gold, platinum, silver, aluminum, doped polysilicon, alloys thereof, and/or other materials. The conductive layer 550 is patterned to form traces and/or electrodes on the device layer.

Figure 5D:
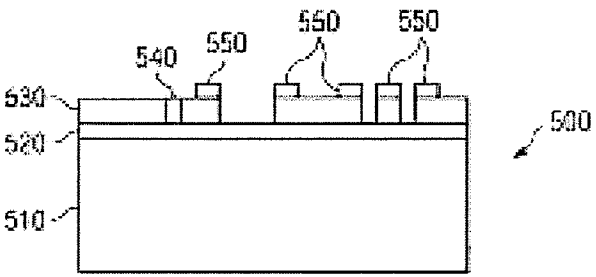

Referring to FIG. 5D, illustrated is a sectional view of the component 500 shown in FIG. 5C in a subsequent stage of manufacture according to aspects of the present disclosure. The device layer 530 and/or the conductive layer 550 are patterned to form connectors and/or sockets, such as the microconnector portions of the lens components 120 and the receptacles configured to receive the microconnector portions. The device layer 530 and/or the conductive layer 550 may also be patterned to form traces and/or electrodes on the device layer. The patterning contemplated in FIG. 5D may also be employed to define the component 500 itself, such as the lenses 120 shown in FIG. 1.

In one embodiment, the substrate 510 may be sized such that the assembly substrate and all or a portion of the lenses 120 employed in a single microassembly may be defined in the device layer of a single substrate, wafer, chip, or die. In another embodiment, the assembly substrate and/or the lens components 120 may be fabricated from multiple substrates, including those of different compositions.

In a subsequent processing step, all or portions of the insulating layer 520 may be removed, such as by one or more wet or dry etching processes. Consequently, at least a portion of the device layer 530 may be "released" from the substrate 510. However, a portion of the device layer 530 may also be tethered to the substrate by a portion or "tether" of the device layer extending between released and non-released portions. Accordingly, the released portion of the device layer 530 may be maintained in a substantially known position to facilitate capture of a released portion of the device layer 530 during a subsequent assembly process.

Figure 6:
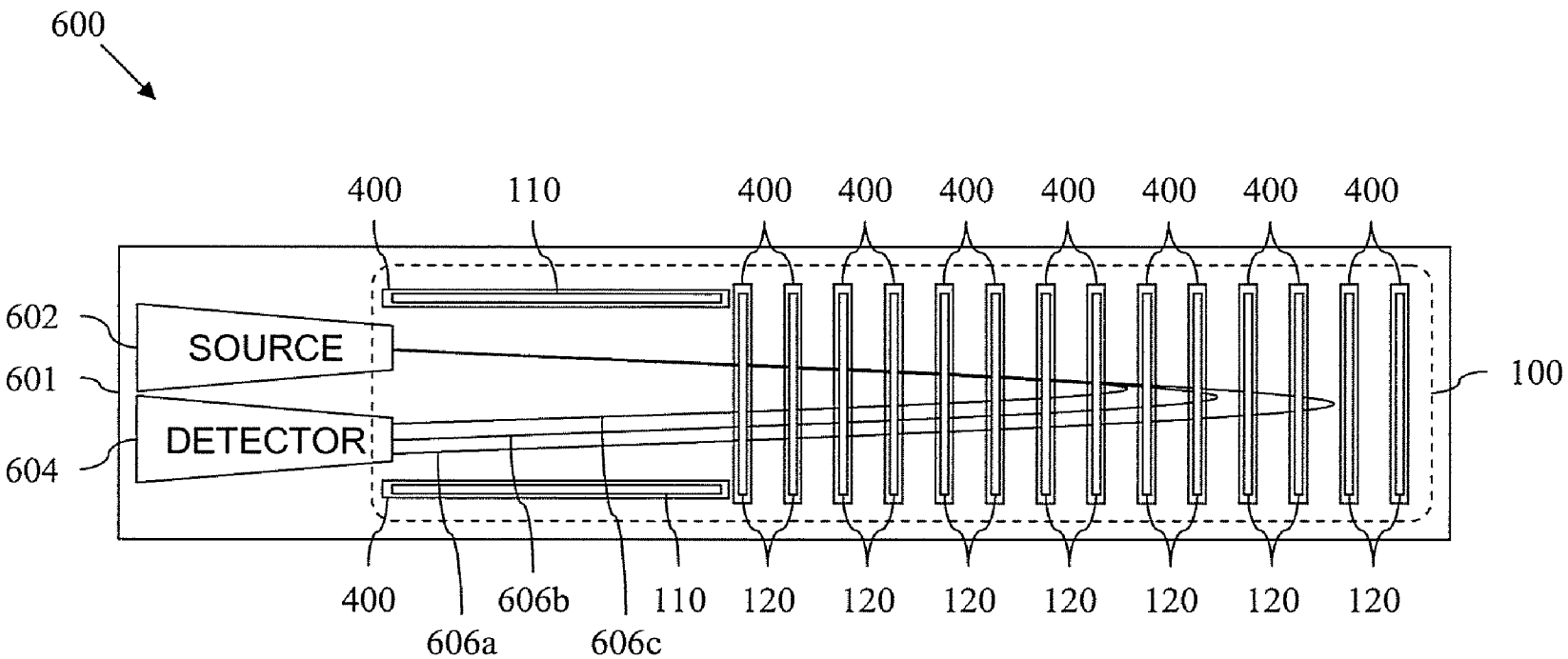
FIG. 6 is a top view of apparatus according to one or more aspects of the present disclosure.

Referring to FIG. 6, illustrated is a schematic view of at least a portion of an exemplary embodiment of apparatus 600 according to one or more aspects of the present disclosure. The apparatus 600 includes the apparatus 100 shown in FIG. 1 and, as such, also includes a substrate 601 (such as any of the substrates described above), a pair of the grid electrodes 110 shown in FIG. 1, and a plurality of the reflective ion lenses 120 shown in FIGS. 1, 2 and 4. The apparatus 600 also includes a plurality of the receptacles 400 shown in FIGS. 3 and 4 for receiving the grid electrodes 110 and the lenses 120, although other means may alternatively or additionally be employed to coupled the grid electrodes 110 and lenses 120 to the substrate 601. At least a portion of the apparatus 600, such as the grid electrodes 110, the lenses 120, and/or the receptacles 400, may be manufactured according to one or more aspects described above with reference to FIGS. 5A-5D, among other possible manufacturing processes within the scope of the present disclosure.

The apparatus 600 also includes an ion source 602 and an ion detector 604 each coupled to the substrate 601. The ion source 602 is or includes an electron impact ionization source, such as the EGA-1110 available from Kimball-Physics Inc., although other ion source means are also within the scope of the present disclosure. The ion detector 604 is or includes a microchannel plate electron multiplier, such as available from Burle Industries, although other ion detection means are also within the scope of the present disclosure.

In an exemplary method of operation, an ion emitter from the ion source 602 travels along one of the paths 606*a*-606*c* shown in FIG. 6 to or towards the ion detector 604. The shape of the ion paths 606*a*-606*c* is partly determined by the known constant or variable electrical signal delivered to each or ones of the lenses 120. The shape of the ion paths 606*a*-60*c* is further determined by the mass of the ion traveling through the lenses 120. For example, consider that an ion A having a mass X travels along the ion path 606*a*, an ion B having a mass Y travels along the ion path 606*b*, and an ion C having a mass Z travels along the ion path 606*c*. Mass X is greater than mass Y, and mass Y is greater than mass Z. Consequently, because ion A is greater in mass than ion B, ion A will require more time relative to ion B to travel from the ion source 602 and through the lenses 120 until ultimately arriving at the ion detector 604. In other words, the ion path 606*a* is longer than the ion path 606*b*. Similarly, because ion C has a smaller mass than ion B, ion C will require less time relative to ion B to travel from the ion source 602 and through the lenses 120 until ultimately arriving at the ion detector 604. In other words, the ion path 606*c* is shorter than the ion path 606*b*.

Accordingly, the times of flight of ions A-C between the ion source 602 and the ion detector 604 are indicative of the relative mass of the ions A-C. That is, because the time of flight for ion A to travel from the ion source 602 to the ion detector 604 through the lenses 120 is greater than the time of flight for ions B and C to travel from the ion source 602 to the ion detector 604 through the lenses 120, the mass X of ion A is known to be greater than the mass Y of ion B and the mass Z of ion C. Consequently, if an ion of known mass is caused to be driven from the ion source 602 to the ion detector 604 through the lenses 120, the time of flight for that ion can be used to calibrate the apparatus 600. Therefore, as additional ions of unknown mass are caused to be driven from the ion source 602 to the ion detector 604 through the lenses 120, their time of flight relative to the known ion's time of flight can be used to determine the relative or specific mass of the ions.

In the exemplary embodiment shown in FIG. 6, the ion paths 606*a-c* each have a substantially single-parabolic shape. The time of flight of each exemplary ion A-C is based on the length of corresponding ion paths 606*a*-606*c*. However, such times may be so small that accurate time of flight measurement, or possibly even ion detection at the detector 604, may be too challenging based on some ion masses and/or dimensions of the apparatus 600. Thus, it may be desirable to utilize the principles discussed above while increasing the ion path lengths and, therefore, their times of flight.

Figure 7:
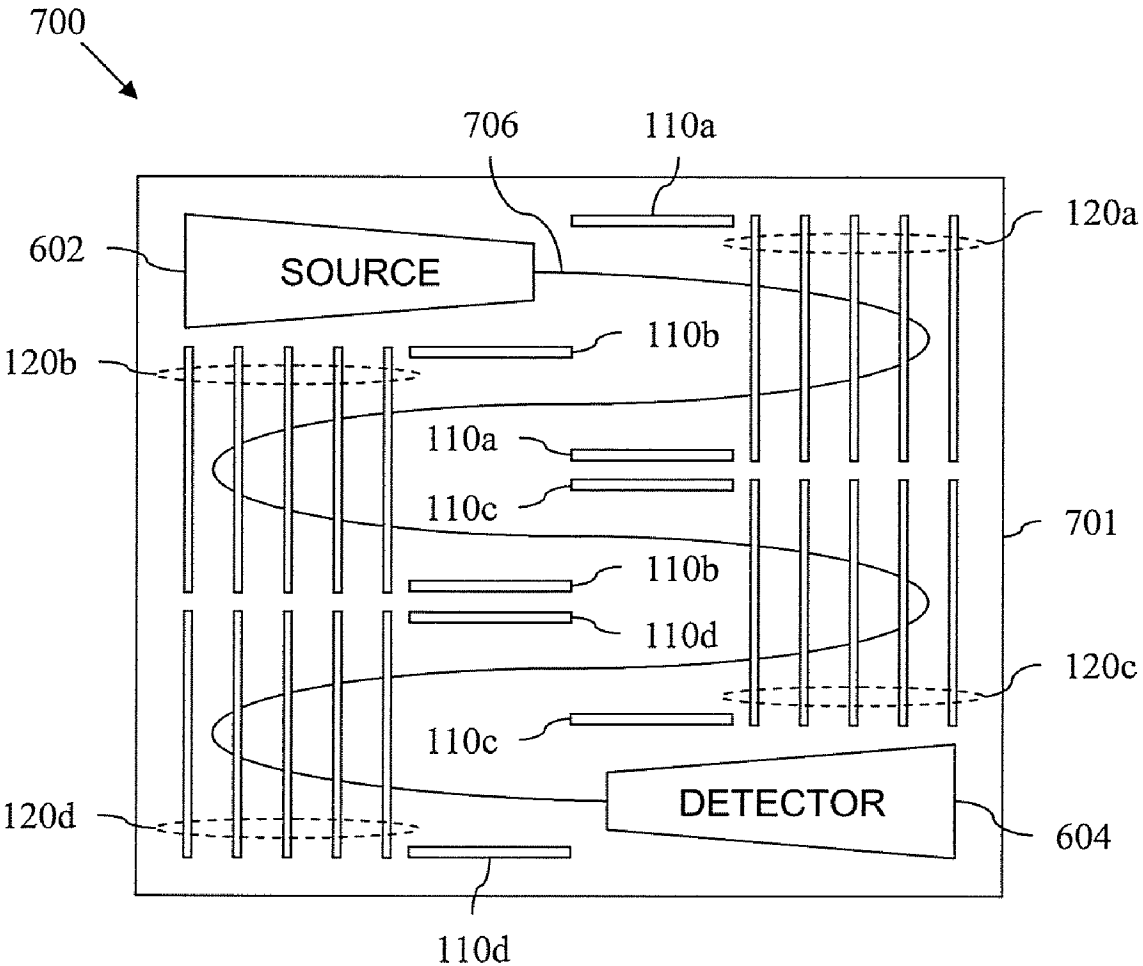
FIG. 7 is a top view of apparatus according to one or more aspects of the present disclosure.

Accordingly, referring to FIG. 7, illustrated is a schematic view of at least a portion of another embodiment of the apparatus 600 shown in FIG. 6, herein designated by the reference number 700. The apparatus 700 includes a substrate 701 which may be substantially similar to one or more of the substrates described above. The apparatus 700 also includes an ion source 602 and an ion detector 604 as described above, each being coupled to the substrate 701.

The apparatus 700 also includes four pairs of grid electrodes 110*a-d* each coupled to the substrate 701 by receptacles (such as the receptacles 400 described above) and/or other means, although such receptacles are not shown in FIG. 7 for the sake of clarity. The apparatus 700 also includes four sets of reflective ion lenses 120*a-d*.

Each pair of grid electrodes 110*a-d* may be substantially similar or identical to the grid electrodes 110 described above. The grid electrodes 110*a* are positioned on the substrate 701 on opposing sides of a hypothetical centerplane 602*a* in a mutually parallel orientation. Similarly, the grid electrodes 110*d* are positioned on the substrate 701 on opposing sides of a hypothetical centerplane 604*a* in a mutually parallel orientation. The grid electrodes 110*b* and 110*c* are positioned on the substrate 701 such that each individual electrode substantially coincides with or is proximate a central axis of an opposing set of lenses 120*a-d*. The four sets of lenses 120*a-d* are positioned on the substrate 701 in an opposing, staggered manner.

The orientation of the four pairs of grid electrodes 110*a-d* and the four sets of lenses 120*a-d* is best explained by describing the ion path 706 of an ion emitted from the ion source 602 as the ion travels through the grid electrodes 110*a-d* and lenses 120*a-d* to or towards the ion detector 604. That is, as an ion is emitted from the ion source 602, it first travels through the grid electrodes 110*a*. The lenses 120*a* then reflect the ion towards an opposite direction, such that the ion travels through the grid electrodes 110*a* in the opposite direction, ultimately to travel through the grid electrodes 110*b*. The lenses 120*b* then reflect the ion towards another direction that is substantially parallel to the ions initial direction (when emitted from the ion source 602), ultimately to travel through the grid electrodes 110*c*. The lenses 120*c* then reflect the ion towards an opposite direction, ultimately to travel through the grid electrodes 110*d*. The lenses 120*d* then reflect the ion towards the ion deflector 604.

The exemplary embodiment depicted in FIG. 7 demonstrates that the ion reflective principles achievable by the apparatus of FIGS. 1-6 may be utilized to increase the time of flight of an ion traveling between an ion source and an ion detector, but while also utilizing the surface area of the substrate in the most efficient manner. Thus, while the apparatus 700 shown in FIG. 7 utilizes four sets of grid electrodes and lenses to achieve an ion path having a substantially quadruple-parabolic shape, other numbers of grid electrodes and lenses may be utilized to achieve other ion path shapes. Moreover, while the exemplary embodiment shown in FIG. 7 depicts each set of ion reflection lenses 120*a-d* as having the same number of lenses, other embodiments within the scope of the present disclosure may utilize lens sets with different numbers of lenses.

In each of the exemplary embodiments described above and other embodiments within the scope of the present disclosure, the thickness of the ion reflection lenses and/or the grid electrodes may range between about 5 μm and about 100 μm. For example, the thickness may be about 50 μm. This decreased size relative to past attempts at constructing reflectrons is advantageous in that the overall size of the device can be significantly smaller than previously thought possible. Accordingly, applications utilizing apparatus within the scope of the present disclosure can enable remote and/or mobile TOF mass spectrometers not previously possible.

In view of all of the above, it should be evident that the present disclosure introduces a microelectronics apparatus comprising a substrate, a pair of grid electrodes coupled to the substrate on opposing sides of a central axis, wherein the grid electrodes are substantially parallel to each other and extend substantially perpendicular from the substrate, and a plurality of ion reflection lenses each coupled to the substrate, wherein each ion reflection lens: (1) is substantially perpendicular to each of the grid electrodes; (2) extends substantially perpendicular from the substrate; and (3) has an aperture aligned with the central axis.

The present disclosure also introduces a method of manufacturing a microelectronics comprising coupling an ion source and an ion detector to a substrate, coupling a pair of grid electrodes to the substrate on opposing sides of a central axis of the ion source, and coupling a plurality of ion reflection lenses to the substrate in series such that the grid electrodes interpose the ion source and the plurality of ion reflection lenses, wherein the grid electrodes and the ion reflection lenses are electrically biased to collectively direct ions emitted from the ion source to travel through the grid electrodes and the ion reflection lenses back towards the ion detector.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A microelectronics apparatus, comprising:

a substrate;

a pair of grid electrodes coupled to the substrate on opposing sides of a central axis, wherein the grid electrodes are substantially parallel to each other and extend substantially perpendicular from the substrate; and a plurality of ion reflection lenses coupled to the substrate, wherein each ion reflection lens:

is substantially perpendicular to each of the grid electrodes;

extends substantially perpendicular from the substrate; and has an aperture aligned with the central axis has a thickness ranging between about 5 μm and about 100 μm.

2. The apparatus of claim 1 wherein each ion reflection lens comprises a microconnector portion configured to couple with a corresponding socket formed in the substrate.

3. The apparatus of claim 1 wherein the substrate includes a plurality of traces configured to deliver an electrical signal to the grid electrodes and ion reflection lenses.

4. The apparatus of claim 1 further comprising an ion source and an ion detector each coupled to the substrate, wherein the grid electrodes and the ion reflection lenses are configured to direct an ion emitted from the ion source towards the ion detector.

5. The apparatus of claim 4 wherein the ion source and ion detector are oriented side-by-side.

6. The apparatus of claim 1 wherein the pair of grid electrodes is a first pair of a grid electrodes, the plurality of ion reflection lenses is a plurality of first ion reflection lenses, and the apparatus further comprises:

a second pair of grid electrodes coupled to the substrate;

a third pair of grid electrodes coupled to the substrate;

a fourth pair of grid electrodes coupled to the substrate;

a plurality of second ion reflection lenses coupled to the substrate;

a plurality of third ion reflection lenses coupled to the substrate; and a plurality of fourth ion reflection lenses coupled to the substrate, wherein:

the first pair grid electrodes and the plurality of first ion reflection lenses are collectively configured to direct an ion from an ion source coupled to the substrate towards the second pair of grid electrodes and the plurality of second ion reflection lenses, collectively;

the second pair of grid electrodes and the plurality of second ion reflection lenses are collectively configured to direct the ion from the first pair of grid electrodes and the plurality of first ion reflection lenses, collectively, towards the third pair of grid electrodes and the plurality of third ion reflection lenses, collectively;

the third pair of grid electrodes and the plurality of third ion reflection lenses are collectively configured to direct the ion from the second pair of grid electrodes and the plurality of second ion reflection lenses, collectively, towards the fourth pair of grid electrodes and the plurality of fourth ion reflection lenses, collectively; and the fourth pair of grid electrodes and the plurality of fourth ion reflection lenses are collectively configured to direction the ion from the third pair of grid electrodes and the plurality of third ion reflection lenses, collectively, towards an ion detector coupled to the substrate.

7. The apparatus of claim 6 wherein the pluralities of first, second, third and fourth ion reflection lenses each comprise the same number of ion reflection lenses.

8. The apparatus of claim 1 wherein the ion reflection lenses each have a thickness of about 50 μm.

9. The apparatus of claim 1 wherein the ion reflection lenses each have a central aperture that is metallized such that, upon being energized, the metallized central aperture creates an electronic field configured to modify direction of ion flight therethrough.

10. A method of manufacturing a microelectronics, comprising:

coupling an ion source and an ion detector to a substrate;

coupling a pair of grid electrodes to the substrate on opposing sides of a central axis of the ion source; and coupling a plurality of ion reflection lenses to the substrate in series such that the grid electrodes interpose the ion source and the plurality of ion reflection lenses;

wherein the ion reflection lenses each have a thickness ranging between about 5 μm and about 100 μm wherein the grid electrodes and the ion reflection lenses are electrically biased to collectively direct ions emitted from the ion source to travel through the grid electrodes and the ion reflection lenses back towards the ion detector.

11. The method of claim 10 wherein each ion reflection lens comprises a microconnector portion configured to couple with a corresponding socket formed in the substrate, such that coupling the grid electrodes and ion reflection lenses to the substrate comprises coupling a corresponding microconnector portion and socket pair.

12. The method of claim 10 wherein the substrate includes a plurality of traces configured to deliver an electrical signal to the grid electrodes and ion reflection lenses.

13. The method of claim 10 wherein coupling the ion source and ion detector to the substrate comprises orienting the ion source and ion detector side-by-side on the substrate.

14. The method of claim 10 wherein the pair of grid electrodes is a first pair of a grid electrodes, the plurality of ion reflection lenses is a plurality of first ion reflection lenses, and the method further comprises:

coupling a second pair of grid electrodes to the substrate;

coupling a third pair of grid electrodes to the substrate;

coupling a fourth pair of grid electrodes to the substrate;

coupling a plurality of second ion reflection lenses to the substrate;

coupling a plurality of third ion reflection lenses to the substrate; and coupling a plurality of fourth ion reflection lenses to the substrate, wherein:

the first pair grid electrodes and the plurality of first ion reflection lenses are collectively configured to direct an ion from an ion source coupled to the substrate towards the second pair of grid electrodes and the plurality of second ion reflection lenses, collectively;

the second pair of grid electrodes and the plurality of second ion reflection lenses are collectively configured to direct the ion from the first pair of grid electrodes and the plurality of first ion reflection lenses, collectively, towards the third pair of grid electrodes and the plurality of third ion reflection lenses, collectively;

the third pair of grid electrodes and the plurality of third ion reflection lenses are collectively configured to direct the ion from the second pair of grid electrodes and the plurality of second ion reflection lenses, collectively, towards the fourth pair of grid electrodes and the plurality of fourth ion reflection lenses, collectively; and the fourth pair of grid electrodes and the plurality of fourth ion reflection lenses are collectively configured to direction the ion from the third pair of grid electrodes and the plurality of third ion reflection lenses, collectively, towards an ion detector coupled to the substrate.

15. The method of claim 14 wherein the pluralities of first, second, third and fourth ion reflection lenses each comprise the same number of ion reflection lenses.

16. The method of claim 10 wherein the ion reflection lenses each have a thickness of about 50 μm.

17. The method of claim 10 further comprising:

forming the grid electrodes and ion reflection lenses in corresponding first locations in the substrate;

releasing the grid electrodes and ion reflection lenses from the substrate after each are formed; and repositioning the released grid electrodes and ion reflection lenses from their corresponding first locations towards corresponding second positions;

wherein coupling the grid electrodes and ion reflection lenses to the substrate comprises coupling the grid electrodes and ion reflection lenses to the substrate in their corresponding second positions.

18. The method of claim 10 wherein the ion reflection lenses each have a central aperture that is metallized such that, upon being energized, the metallized central aperture creates an electronic field configured to modify direction of ion flight therethrough.

* * * * *